United States Patent [19]

Mott

[11] Patent Number: 5,017,040

[45] Date of Patent: May 21, 1991

[54] SEWAGE DISPOSAL SYSTEM AND METHOD

[76] Inventor: Edward B. Mott, 25 Kendall Dr., Ringwood, N.J. 07456

[21] Appl. No.: 514,281

[22] Filed: Apr. 25, 1990

[51] Int. Cl.[5] ..... F02B 11/00; F02B 13/00

[52] U.S. Cl. ..... 405/32; 47/9; 47/56; 210/170; 405/43

[58] Field of Search ..... 405/36, 43, 37, 45, 405/258; 210/170; 47/9, 56; 111/200, 901; 106/900

[56] References Cited

U.S. PATENT DOCUMENTS

| | | | |
|---|---|---|---|
| 3,908,385 | 9/1975 | Daniel et al. | 405/37 |
| 3,914,901 | 10/1975 | Muldner | 47/56 |
| 4,023,506 | 5/1977 | Robey | 111/901 X |
| 4,091,568 | 5/1978 | Zinter | 47/56 X |
| 4,188,154 | 2/1980 | Izatt | 405/38 X |
| 4,303,350 | 12/1981 | Dix | 405/36 |
| 4,337,077 | 6/1982 | Rutherford | 47/9 X |

*Primary Examiner*—Dennis L. Taylor

*Attorney, Agent, or Firm*—Samuelson & Jacob

[57] ABSTRACT

An improvement in a sewage disposal system and method of the type in which sewage is distributed to an effluent absorption area in the earth for dissipation to the earth includes placing a layer of peat moss over the effluent absorption area to essentially cover the effluent absorption area and interposing a porous sheet, preferably of geotextile fabric, between the layer of peat moss and the effluent absorption area.

18 Claims, 1 Drawing Sheet

SEWAGE DISPOSAL SYSTEM AND METHOD

The present invention relates generally to sewage and waste disposal and pertains, more specifically, to an improvement in a sewage disposal system and method of the type in which sewage is distributed to an effluent absorption area for dissipation to the earth.

Sewage disposal systems of the type in which waste is distributed to an effluent absorption area have been in use for a very long time and still are quite common. Individual sewage disposal systems still are prevalent in rural and even suburban areas where community sewage disposal systems have not yet been installed. These sewage and waste disposal systems usually employ a field having a treatment bed embedded in surrounding ground for dissipation of effluent through the treatment bed to the earth. While currently available systems of the type described are effective, these systems require regular maintenance in order to preserve effectiveness, as well as to control odor and maintain an acceptable outward appearance.

The present invention provides an improvement in sewage and waste disposal systems and methods of the type described and provides several objects and advantages, some of which are summarized as follows: Facilitates maintenance of the disposal system by providing ease of access to the effluent absorption area for the removal of any blockage which may develop during use of the system and for rejuvenation of the area, as necessary; reduces odors endemic to sewage disposal areas; provides for economical covering of the effluent absorption area of a sewage disposal system of the type described; supports the growth of ground cover over the effluent absorption area; promotes the air circulation necessary for neutralization of sewage directed to the effluent absorption area; simplifies the installation, operation and maintenance of a wide variety of individual sewage disposal systems for widespread economical and effective use.

The above objects and advantages, as well as further objects and advantages, are attained by the present invention which may described briefly as an improvement in a sewage disposal system and method in which sewage is distributed to an effluent absorption area in the earth for dissipation to the earth, the improvement comprising providing a layer of peat moss overlying the effluent absorption area to essentially cover the effluent absorption area.

Figure 1:
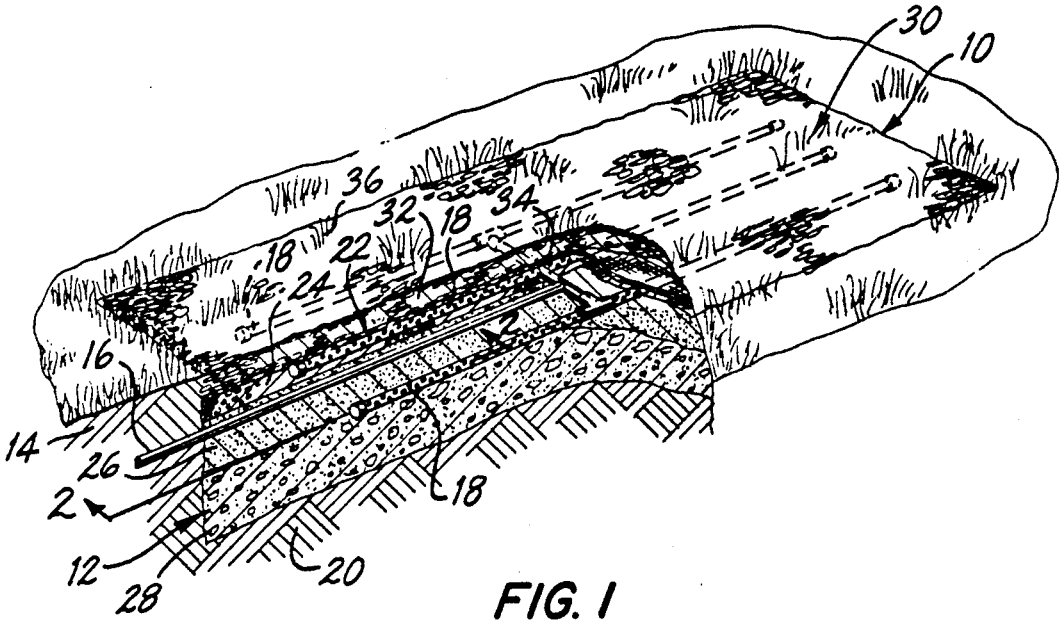
Figure 2:
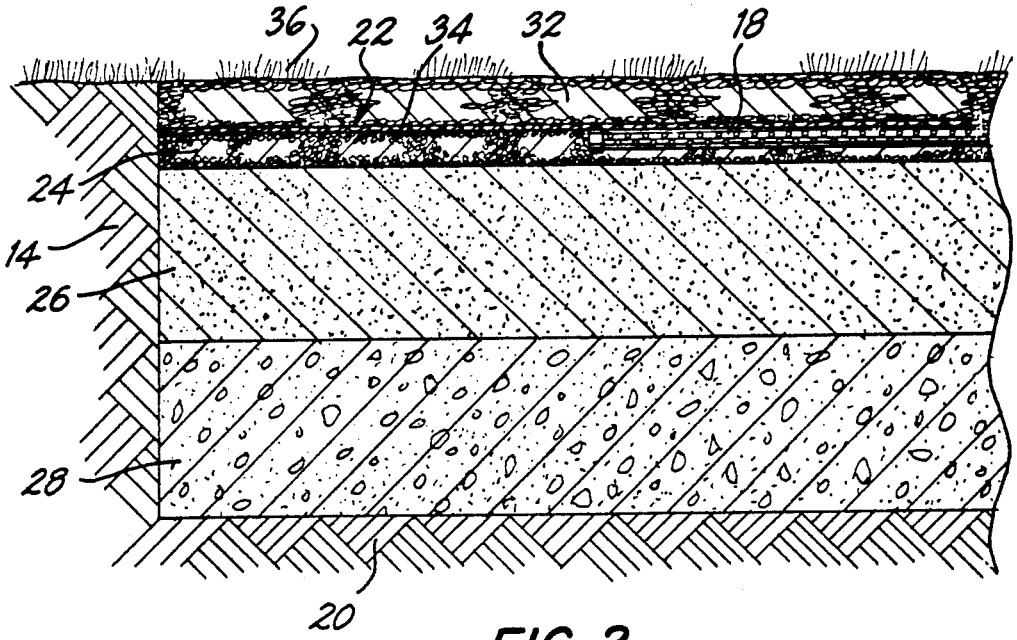

The invention will be understood more fully, while still further objects and advantages will become apparent, in the following detailed description of a preferred embodiment of the invention illustrated in the accompanying drawing, in which:

FIG. 1 is a pictorial perspective view, partially broken away, of a sewage disposal system constructed in accordance with the improvement of the invention; and FIG. 2 is an enlarged, fragmentary cross-sectional view taken along line 2—2 of FIG. 1.

Referring now to the drawing, a sewage disposal system 10 includes an effluent absorption area 12 surrounded by earth 14. Sewage is pumped to the effluent absorption area 12 through an inlet transport pipe 16 and is distributed throughout the effluent absorption area 12 by a distribution network of perforated distributor pipes 18 connected to the inlet transport pipe 16 for dissipation through the effluent absorption area 12 to the earth 20 beneath the effluent absorption area 12.

Typically, the effluent absorption area 12 includes a treatment bed 22 having layers of sand and gravel for treating the sewage as the sewage is dissipated to the earth. In the illustrated embodiment, the treatment bed 22 includes an upper layer 24 of gravel, and intermediate layer 26 of sand, and a lower layer 28 of a mixture of sand and gravel; however, the construction of the treatment bed 22 may be varied from installation to installation.

A cover 30 overlies the effluent absorption area 12. In conventional sewage disposal systems of the type described, the cover usually is made up of a layer of earth. In the improvement of the present invention, the effluent absorption area 12 is covered with a layer 32 of peat moss. Preferably, a sheet 34 of porous material is interposed between the layer 32 of peat moss and the treatment bed 22. It has been found that the layer 32 of peat moss provides an advantageous cover 30 in that the layer 32 is effective in covering the effluent absorption area 12 while promoting the circulation of air to the treatment bed 22 for effective treatment of the effluent distributed to the treatment bed 22. The effluent itself provides sufficient moisture to the layer 32 to prevent drying out of the peat moss and maintain the peat moss in place. A relatively thin layer 32 of peat moss, in the range of about two to four inches, is sufficient to cover the effluent absorption area 12. Preferably, the layer 32 of peat moss is flush with the surrounding earth 20 and fully supports the growth of ground cover, as illustrated at 36, so that the sewage disposal system 10 does not constitute an intrusion into the aesthetic appearance of the area. Moreover, the presence of the peat moss reduces the emanation of odors usually associated with sewage disposal systems. The preferred peat moss is of the genus sphagnum which appears to include natural biological agents conducive to the use of peat moss as a covering material in the sewage disposal system 10.

The sheet 34 of porous material enables easy access to the treatment bed 22 for maintenance. Thus, should it become necessary to gain access to the treatment bed 22, either for rejuvenation or replacement of the treatment bed 22, the sheet 34 merely is lifted from the treatment bed 22. The light weight of the layer 32 of peat moss facilitates the removal of cover 30 and access to the treatment bed 22. Replacement of the cover 30 is a relatively simple matter. Sheet 34 is constructed of a geotextile, advantageously a synthetic polymeric material, the preferred material being a spunbonded polypropylene fabric available under the trademark TYPAR. A sheet of such a material having a thickness of only about one-sixteenth of an inch has been found effective, in terms of performance, strength and longevity. The porosity of the material allows air to circulate to the treatment bed 22 for effective operation of the sewage disposal system 10. At the same time moisture can pass through the sheet 34 upwardly to keep the layer 32 of peat moss from drying out, and downwardly to prevent rot. The relatively thin sheet 34 is laid flat over the treatment bed 22 and need not be anchored with supplemental hold-down devices.

It will be seen that the present invention provides several objects and advantages, some of which were summarized above, as follows: Facilitates maintenance of the disposal system by providing ease of access to the effluent absorption area for the removal of any blockage which may develop during use of the system and for rejuvenation of the area, as necessary; reduces odors endemic to sewage disposal areas; provides for economical covering of the effluent absorption area of a sewage disposal system of the type described; supports the growth of ground cover over the effluent absorption area; promotes the air circulation necessary for neutralization of sewage directed to the effluent absorption area; simplifies the installation, operation and maintenance of a wide variety of individual sewage disposal systems for widespread economical and effective use.

It is to be understood that the above detailed description of a preferred embodiment of the invention is provided by way of example only. Various details of design, construction and procedure may be modified without departing from the true spirit and scope of the invention, as set forth in the appended claims.

The embodiments of an invention in which an exclusive property or privilege is claimed are defined as follows:

1. In a sewage disposal system of the type in which sewage is distributed to an effluent absorption area in the earth for dissipation to the earth, the improvement comprising a layer of peat moss overlying the effluent absorption area to essentially cover the effluent absorption area for enabling air circulation to the effluent absorption area while reducing odor, and facilitating access to the effluent absorption area for maintenance of the sewage disposal system.

2. The improvement of claim 1 wherein the layer of peat moss has a depth of about two inches to four inches.

3. The improvement of claim 1 wherein the layer of peat moss is essentially flush with the surrounding earth.

4. The improvement of claim 1 wherein the peat moss is of the genu sphagnum.

5. The improvement of claim 1 including a porous sheet interposed between the layer of peat moss and the effluent absorption area.

6. The improvement of claim 5 wherein the porous sheet is constructed of a geotextile.

7. The improvement of claim 5 wherein the porous sheet is constructed of a synthetic polymeric material.

8. The improvement of claim 5 wherein the porous sheet is constructed of spunbonded polypropylene fabric.

9. The improvement of claim 5 wherein the porous sheet has a thickness of about one-sixteenth inch.

10. In a method for sewage disposal utilizing a sewage disposal system of the type in which sewage is distributed to an effluent absorption area in the earth for dissipation to the earth, the improvement comprising placing a layer of peat moss over the effluent absorption area to essentially cover the effluent absorption area for enabling air circulation to the effluent absorption area while reducing odor, and facilitating access to the effluent absorption area for maintenance of the sewage disposal system.

11. The improvement of claim 10 wherein the layer of peat moss is placed to a depth of about two inches to four inches.

12. The improvement of claim 10 wherein the layer of peat moss is placed essentially flush with the surrounding earth.

13. The improvement of claim 10 wherein the peat moss is of the genus sphagnum.

14. The improvement of claim 10 including interposing a porous sheet between the layer of peat moss and the effluent absorption area.

15. The improvement of claim 14 wherein the porous sheet is constructed of a geotextile.

16. The improvement of claim 14 wherein the porous sheet is constructed of a synthetic polymeric material.

17. The improvement of claim 14 wherein the porous sheet is constructed of spunbonded polypropylene fabric.

18. The improvement of claim 14 wherein the porous sheet has a thickness of about one-sixteenth inch.

* * * * *